US010934729B2

(12) United States Patent
Guilfoyle et al.

(10) Patent No.: US 10,934,729 B2
(45) Date of Patent: Mar. 2, 2021

(54) SPA COVER WITH SENSOR

(71) Applicant: Bullfrog International, LC, Bluffdale, UT (US)

(72) Inventors: Jeff Guilfoyle, San Diego, CA (US); Dan Sjoblom, Sandy, UT (US); Eric Hales, Eagle Mountain, UT (US)

(73) Assignee: Bullfrog International, LC, Herriman, UT (US)

( * ) Notice: Subject to any disclaimer, the term of this patent is extended or adjusted under 35 U.S.C. 154(b) by 58 days.

(21) Appl. No.: 16/287,813

(22) Filed: Feb. 27, 2019

(65) Prior Publication Data

US 2020/0270886 A1 Aug. 27, 2020

(51) Int. Cl.
*E04H 4/08* (2006.01)

(52) U.S. Cl.
CPC ..... *E04H 4/08* (2013.01)

(58) Field of Classification Search
CPC ..... E04H 4/08
USPC ..... 4/498
See application file for complete search history.

(56) References Cited

U.S. PATENT DOCUMENTS

| | | | |
|---|---|---|---|
| 3,548,157 | A | 12/1970 | Lauck |
| 3,555,355 | A | 1/1971 | Pfister et al. |
| 3,813,927 | A | 6/1974 | Furgason |
| 4,455,480 | A | 6/1984 | Matsumoto et al. |
| 4,675,874 | A | 6/1987 | Phler et al. |
| 5,585,025 | A | 12/1996 | Idland |
| 6,246,831 | B1 | 6/2001 | Seitz et al. |
| 6,355,913 | B1 | 3/2002 | Authier et al. |
| 6,476,363 | B1 | 11/2002 | Authier et al. |
| 6,633,726 | B2 | 10/2003 | Bradebaugh |
| 6,965,815 | B1 | 11/2005 | Tompkins et al. |
| 3,014,902 | A1 | 9/2011 | Kates |

(Continued)

FOREIGN PATENT DOCUMENTS

| | | | |
|---|---|---|---|
| CN | 102966765 | A | 3/2013 |
| GB | 2290152 | A | 12/1995 |

(Continued)

OTHER PUBLICATIONS

Amin et al. Design of Microcontroller Based Thyristor Controlled Three-Phase Static Volt-Ampere Reactive Compensator, 2014, 3rd International Conference on Informatics, Electronics, & Vision 2014 (Year: 2014).

(Continued)

*Primary Examiner* — Jeremy Carroll
(74) *Attorney, Agent, or Firm* — Dentons Durham Jones Pinegar; Sarah W. Matthews; James A. Larson

(57) ABSTRACT

A spa cover and sensor are disclosed. The spa cover may include a rigid portion and a floating portion connected to the rigid portion to reduce heat loss. A sensor may be provided within the spa cover, the spa tub, or a combination of the cover and tub to determine when a cover is in an open or closed position over the spa tub. A processor may communicate with other automated features of the spa and/or cover, such as, causing air bladders in the cover to automatically inflate when the cover is in a closed position or locking or unlocking the spa cover. The processor may communicate with features on the spa, such as initiating custom start settings when the cover is removed from the spa tub, or initiate energy saving functions with the cover is placed over the spa tub.

38 Claims, 10 Drawing Sheets

(56) References Cited

U.S. PATENT DOCUMENTS

| | | | | |
|---|---|---|---|---|
| 2006/0162719 | A1 | 7/2006 | Gougerot et al. | |
| 2006/0238931 | A1* | 10/2006 | Cline | A61H 33/005 361/42 |
| 2008/0041839 | A1 | 2/2008 | Tran | |
| 2009/0204263 | A1 | 8/2009 | Love | |
| 2009/0255049 | A1* | 10/2009 | Rosenau | A61H 33/02 4/584 |
| 2013/0191983 | A1* | 8/2013 | Imai | E03D 5/016 4/321 |
| 2013/0201316 | A1 | 8/2013 | Binder et al. | |
| 2014/0303757 | A1 | 10/2014 | Pruchniewski et al. | |
| 2015/0260428 | A1 | 9/2015 | Haldeman | |
| 2017/0209338 | A1 | 7/2017 | Potucek et al. | |
| 2017/0211285 | A1* | 7/2017 | Potucek | H04L 61/2007 |
| 2019/0021944 | A1 | 1/2019 | Hollaway | |

FOREIGN PATENT DOCUMENTS

| | | | | |
|---|---|---|---|---|
| JP | 11344901 | A | 12/1999 | |
| WO | 02053987 | A2 | 7/2002 | |
| WO | 2014-022843 | A1 | 2/2014 | |
| WO | WO-2014022843 | A1 * | 2/2014 | E04H 4/082 |

OTHER PUBLICATIONS

Hiaing et al. Microcontroller-Based Single-Phase Automatic Voltage Regulator, 2010, IEEE, 222-226 (Year: 2010).

Machine Translation of CN-102966765-A (Year: 2013).

Machine Translation of JP-11344901-A (Year: 1999).

Skinner et al. Using Smart Sensor Strings for Continuous Monitoring of Temperature Stratification in Large Water Bodies, Dec. 2006, IEEE Sensors Journal, vol. 6 No. 6, 1473-2592. (Year. 2006).

Wang, Kai, et al. Thermoeconomic Assesment of a PV/T Combined Heating and Power System for University Sport Centre of Bari. 158 vol. 2019. Ei Compendex. Web. Aug. 13, 2019.

USPTO as International Searching Authority, "International Search Report and Written Opinion", for application No. PCT/US2019/019835, dated Nov. 22, 2019.

* cited by examiner

SPA COVER WITH SENSOR

TECHNICAL FIELD

This disclosure relates generally to covers for pools and spas that cover water to assist in keeping a spa or pool clean from contaminants while not in use and prevent heat loss, and, more specifically, cover design features for automatically detecting when a cover is in place for efficiency, safety and ease of use. The features disclosed herein are numerous in nature and may be utilized in a number of different ways to provide the same or similar results.

RELATED ART

Spas covers are commonly used in conjunction with spas to protect the spa when not in use for a variety of reasons, including safety, energy efficiency, and longevity of the spa. Many spas have a cover that a user manually replaces when the spa is not in use. Spa covers are typically either a rigid type cover or a floating cover. A typical design for a rigid spa cover is one that folds, such as in half with a single hinge for smaller spas, or a 3-panel design for larger spas. The rigid cover rests on the top edge or rim of the spa. Because the cover rests on the top edge of the spa there is an air gap between the surface of the water and the cover, which can cause issues of heat loss and evaporation.

A floating type cover, also known as a spa blanket, rests directly on the surface of the water to decrease evaporation and heat loss, but can be more difficult to use compared to a rigid cover and do not provide as much insulation from ambient air.

Because the cover must be manually replaced, there is a chance that a user may forget to replace the cover. This can lead to waste of energy as the spa is continually heated. It can also lead to dangerous situations if children or pets have access to the open spa.

The spa system described herein with a sensor to determine when the cover is in place takes into account the energy savings of a floating type cover the ease of use of a rigid cover, while at the same time providing safety and convenience to the users of the spa through automated features.

SUMMARY

This disclosure, in at least one aspect, relates to the use of a sensor with a spa for detecting when a cover is in place over the spa. The sensor may communicate with a processor to activate custom settings on the spa when the cover is removed. Similarly, automated settings for beginning a filtration cycle and shutting down the jets and lights in the spa may be activated when the cover is replaced.

According to another aspect, an automated cover lock is described which allows the closed cover to be automatically locked through the use of electromagnets which may be energized when a sensor detects the cover is in place over the spa.

According to another aspect, a spa cover with a rigid portion and a floating portion is described which is easy to deploy. The floating portion may descend from the rigid portion. In some configurations, the floating portion may comprise inflatable sections which are automatically inflated when a sensor detects a cover is in place over a spa, and automatically deflated when the sensor detects the cover is removed.

There is a plurality of means and methods for configurations of the sensor on the spa and/or the spa cover and multiple variations are disclosed herein. Other aspects, as well as features and advantages of various aspects of the disclosed subject matter will become apparent to one of ordinary skill in the art form the ensuing description, the accompanying drawings and the appended claims.

DETAILED DESCRIPTION

Figure 1:
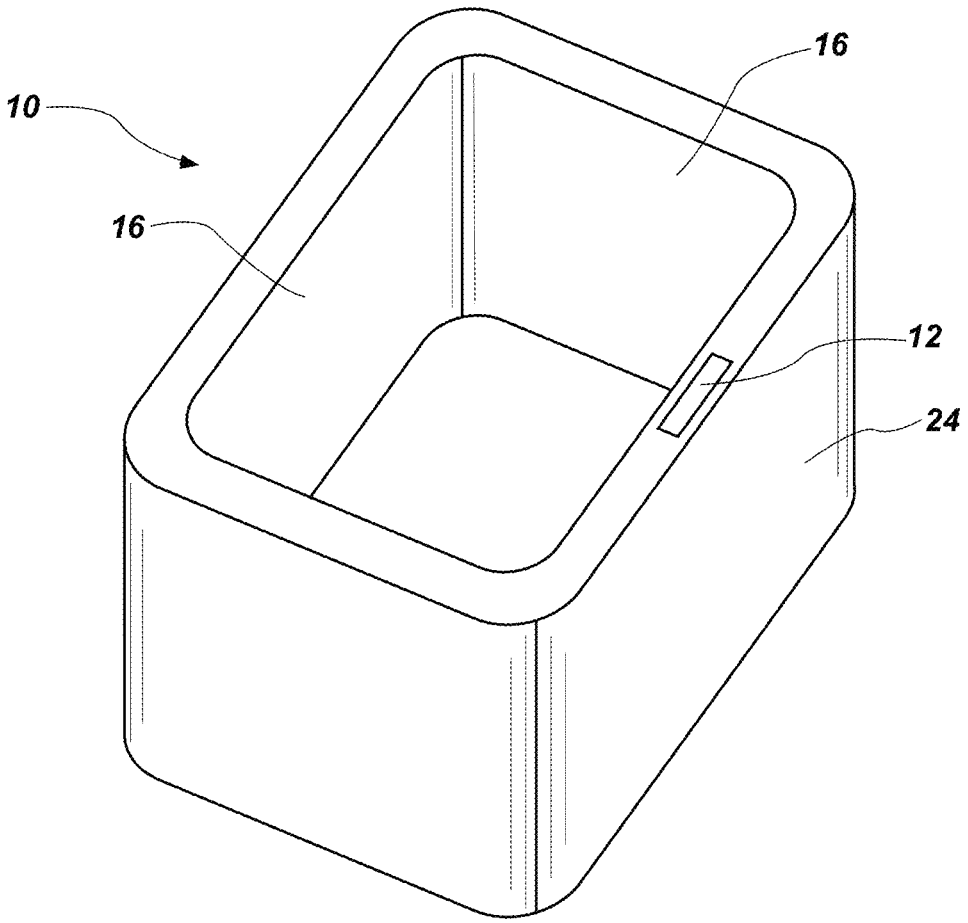
FIG. 1 is a is a top perspective view of a spa with a sensor.
Figure 2:
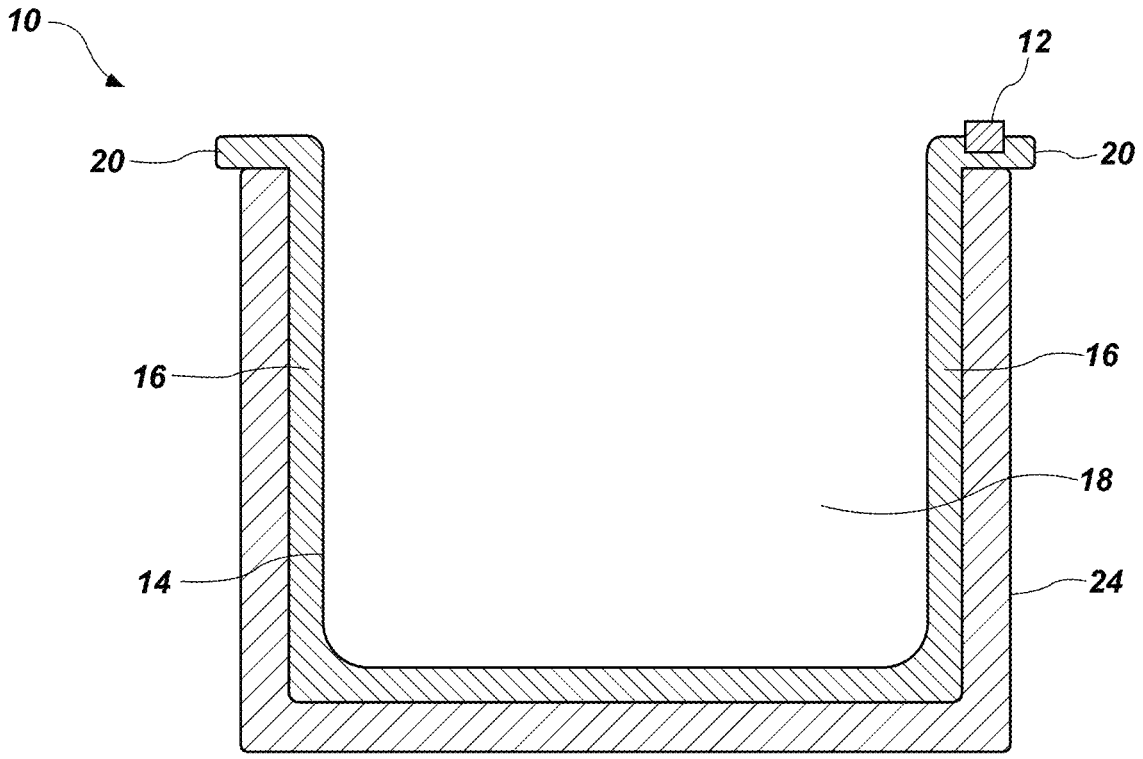
FIG. 2 is a cross-sectional side view of the spa of FIG. 1 with the sensor.
Figure 3:
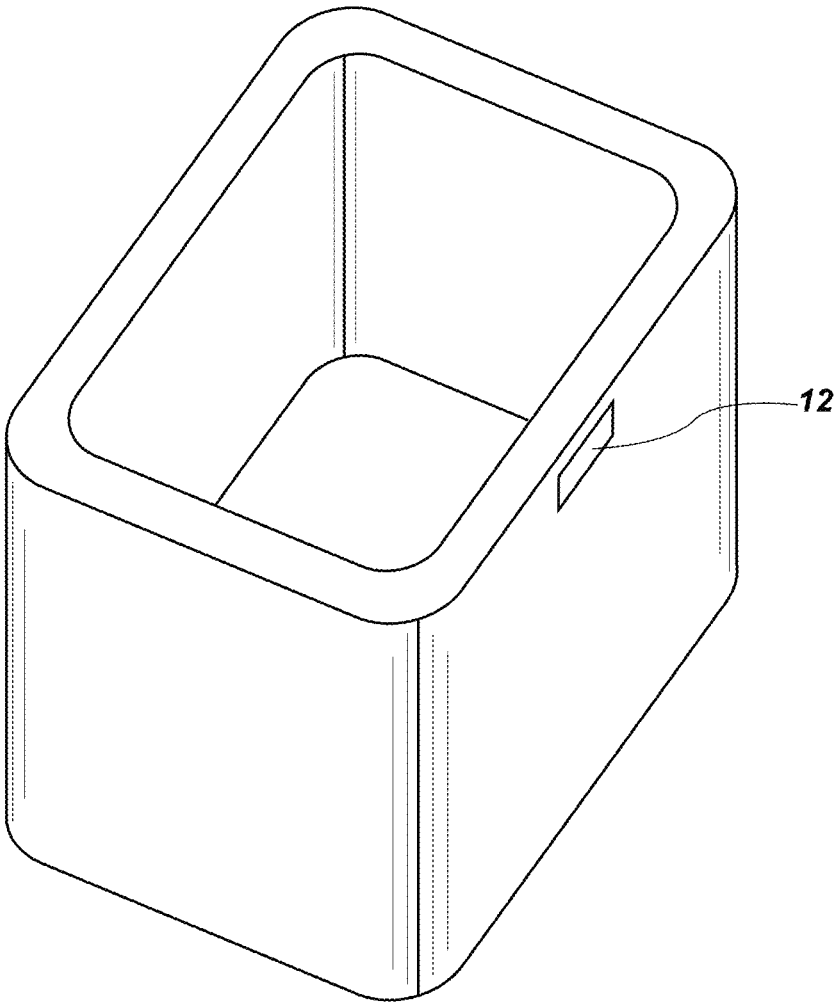
FIG. 3 is top perspective view of another possible configuration of a spa with a sensor.
Figure 4:
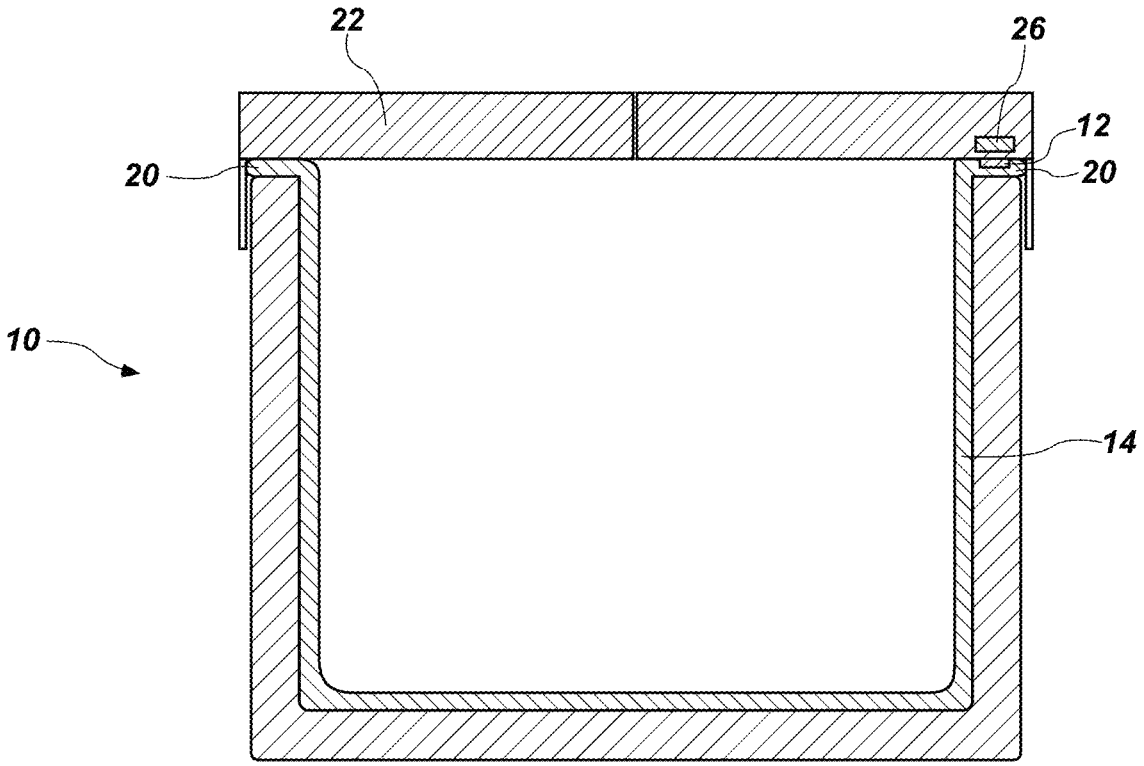
FIG. 4 is a cross-sectional side view of the spa of FIG. 1 with a spa cover in a closed position over the spa.

FIGS. 1-4 illustrate a configuration of a spa tub or pool 10 with a sensor 12. As used herein, "spa," "spa tub," and "heated spa," may be used to refer to a heated or unheated pool or spa, including the shell of a spa, the shell of the spa with a cabinet, an in-ground spa, or an above-ground spa. The spa may be any shaped desired, and may include a spa shell 14 with one or more sidewalls 16 forming a container or space for receiving water. The side walls 16 may have a top edge 20. A cover placed over a spa 10 would typically rest on the top edge 20 of the sidewall and may extend down the sidewall, such as a cover with a skirt portion. The spa 10 may include at least one sensor 12 disposed on the top edge 20 of the spa shell 14 or proximal to the top edge 18 such that the sensor 12 may be able to detect the presence or absence of a cover over the spa 10. The cover may be configured to rest on the top edge of the spa 10 or extend below the top edge 20 of the spa down at least a portion of the side walls 16. However, it will be appreciated that the position of the sensor 12 may be in any location on the spa 10 that allows interface or interaction between the sensor and the spa cover. The cover is intended to cover an opening 13. The opening 13 may be where a user accesses the spa 10. The sensor may be able to determine when the spa is in a first configuration wherein the spa cover is open and not positioned over the opening 13 and a second configuration wherein the spa cover is closed to cover the opening 13. The sensor 12 may be placed on the top edge 20 as shown in FIGS. 1-2, or placed near the top edge 18 of a sidewall as shown in FIGS. 3-4. Depending on the type of sensor 12 used, the sensor 12 may be placed at other locations on the spa shell 14 and/or spa cabinet 24. The sensor may be formed integrally to the spa shell 14 or spa cabinet 24, or may be otherwise attached.

The sensor 12 may be any suitable sensor known in the art for determining if a spa cover is in place over the spa. For example, a physical sensor could be used such as a pressure sensor to detect the pressure of a cover placed over the sensor 12. Light sensors could also be used, such as a photoresistor, a photodiode, a phototransistor, or other variations. The sensor 12 may also work in conjunction with a specific portion of a cover, such as a cover which has magnets. In that setting the sensor 12 located on the spa 10 may be a magnetic proximity sensor such as a reed switch. A microelectromechanical (MEMS)-based magnetic field sensor, such as a Lorentz-force-based MEMS sensor, may be used. A Hall effect sensor, magneto-diode, compass, or other similar sensor may be used. Inductive sensors and capacitive sensors may be used. It will be appreciated that a number of sensors may be used and are contemplated as well as multiple different sensors on a single spa 10. Additionally, the sensor 12 may provide a separate function of locking as well as unlocking a spa cover from the spa 10 itself. For example, in the instance of a magnetic sensor or magnetic proximity sensor the magnet may also function as a lock to prevent or allow the cover to be moved from a first configuration to a second configuration and vis versa. Separately, a locking mechanism may be integrated into the spa 10 and spa cover separate from the sensor. The locking mechanism may be electronically controlled through the same means as the sensors. The sensor 12 may be in communication with one or more processors/controllers as described in detail herein.

FIG. 4 illustrates a spa 10 in conjunction with a spa cover 22. It will be appreciated that depending on the type of sensor used, any standard spa cover 22 may be used. For example, a typical foam-core type bi-fold cover may be used in conjunction with a pressure sensor located on the top edge 20 of the spa. The weight of the foam-core cover in place over the top edge 20 may trigger the sensor to indicate the cover was in a second configuration, or closed position. Similarly, a light-detecting-type sensor may be used with a standard cover. Such a sensor may be placed on the top edge 20 or near the top of the cabinet 24 such that either a spa cover or a skirt of a spa cover would block light from the sensor when the cover was in a closed position. The sensor 12 of FIG. 3 may be placed on the spa cabinet 24 such that the skirt of a spa cover may block light from the sensor when the cover was in a closed position.

In other configurations the spa 10 may be used with a cover 22 that has one or more features that may be detected by a sensor 12. FIG. 4 shows the spa 10 having a sensor, such as an inductive-type sensor, 12 that may detect the contact or proximity of a magnet 26 located in or on the spa cover 22. It will be appreciated that the location of the sensor and the magnet could be interchanged, with the sensor 12 located on or in the cover 22 and the magnet 26 located on or in proximity to the top edge 20 pf the spa shell or cabinet 24. Such configurations are described in more detail below. Other materials or features capable of being sensed may be placed in the cover 22 and detected by the sensor 12.

The sensor 12 may be connected to one or more of a controller, processor, microprocessor, external memory, a transmitter, a receiver, and/or a transceiver in order to communicate with other controllers and/or settings on the spa, either wirelessly or via wired connection. Various units, circuits, or other components may be described as "configured to" perform a task or tasks. In such contexts, "configured to" is a broad recitation of structure generally meaning "having circuitry that" performs the task or tasks during operation. In general, the circuitry that forms the structure corresponding to "configured to" may include hardware circuits and/or memory storing program instructions executable to implement the operation. The memory can include volatile memory such as static or dynamic random access memory and/or nonvolatile memory such as optical or magnetic disk storage, flash memory, programmable read-only memories, etc. Similarly, various units/circuits/components may be described as performing a task or tasks, for convenience in the description.

Figure 5:
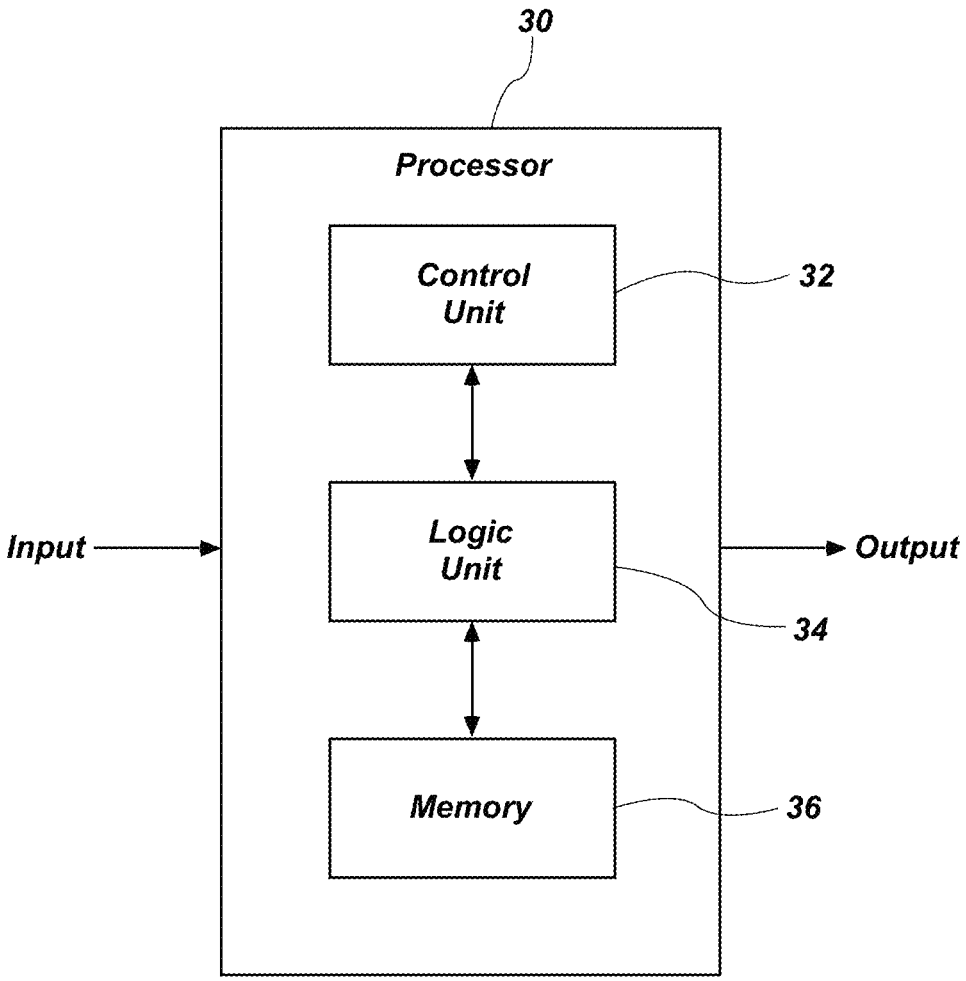
FIG. 5 shows a schematic of a processor that may be used in conjunction with the sensor described herein.

Referring to FIG. 5, the spa may include a processor or microprocessor 30 in communication with the sensor 12. The processor may receive input from sensor 12 and/or other input devices. The processor may include a control unit 32, logic unit 34, and/or memory 36 configured to execute instructions in response to the input received from the sensor 12 and/or other input devices, and output instructions to regulate spa settings. The processor 30 may be configured to communicate an output to elements that control settings on the spa 10; this could include but would not be limited to custom music settings, heat settings, light settings, water features, pump and jet settings, start settings, filter settings, and stop settings. Additionally, those outputs can be to elements that may lock or unlock the cover 22 from the spa 10.

Figure 6:
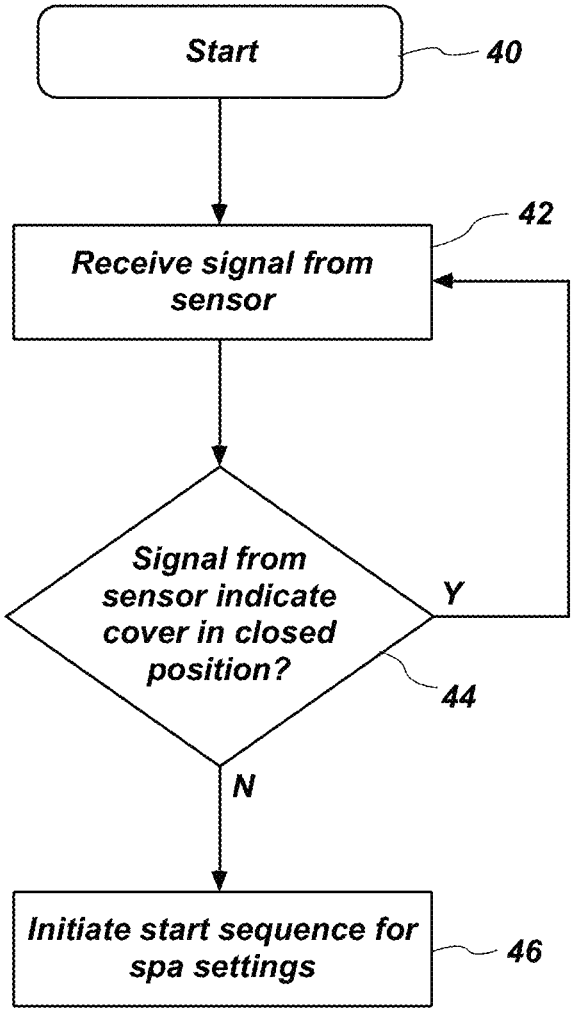
FIG. 6 shows a process flow or logic flow diagram that may be used by the processor of FIG. 5.
Figure 7:
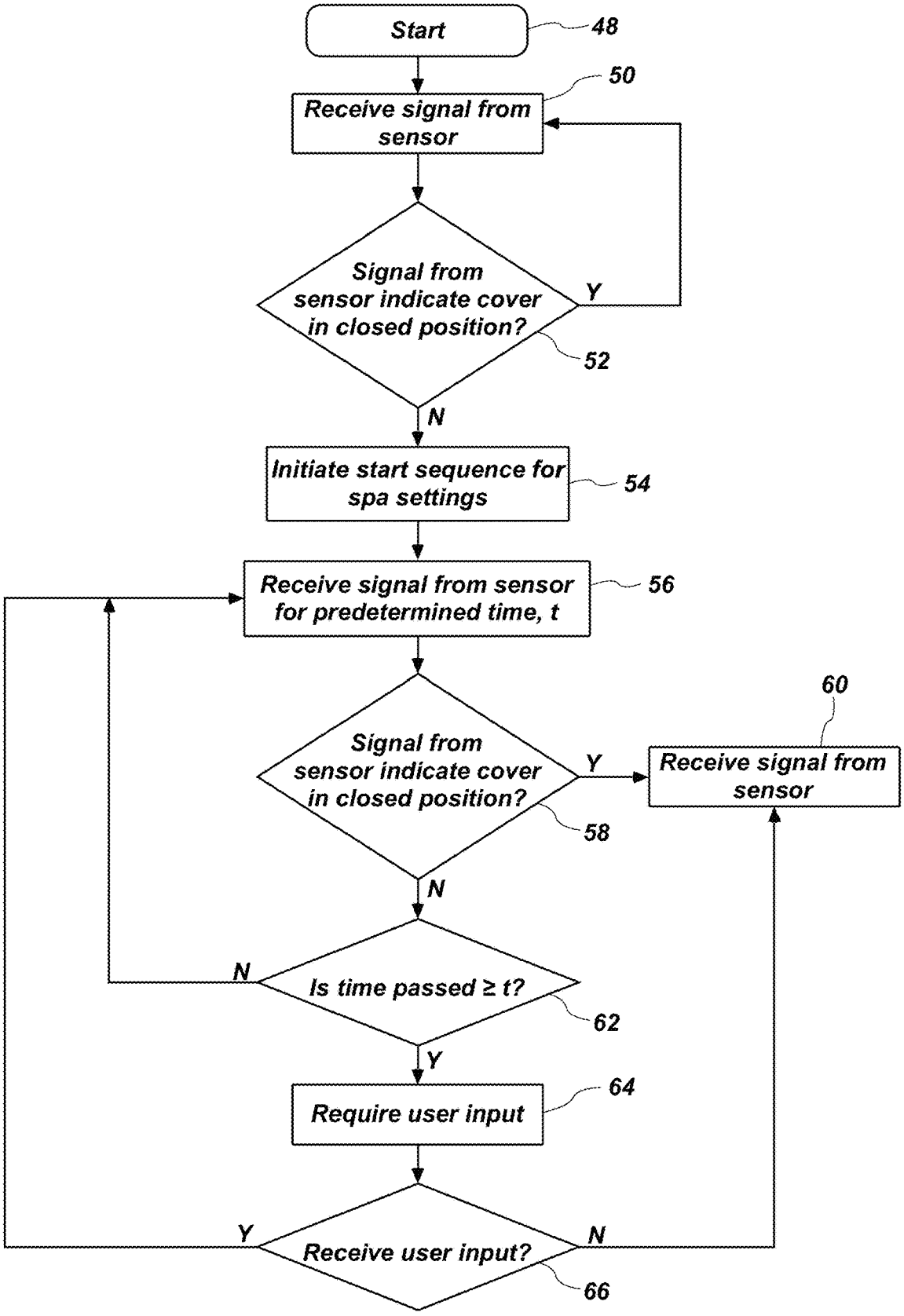
FIG. 7 shows an alternate process flow or logic flow diagram that may be used by the processor of FIG. 5.
Figure 8:
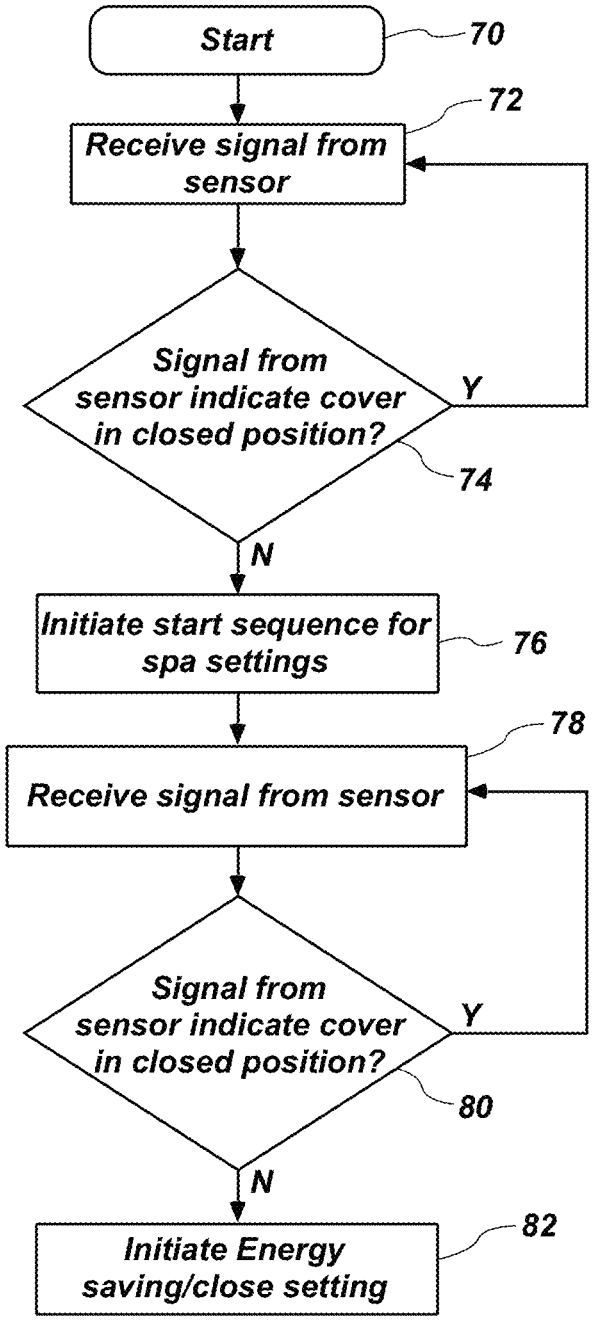
FIG. 8 shows an alternate process flow or logic flow diagram that may be used by the processor of FIG. 5.

FIGS. 6 through 8 illustrate possible configurations of logic that may be carried out within the processor to control spa settings in response to input from the sensor. The processor may start the logic (40), receive a signal either wirelessly or via wired communication (42), and then determine if the signal from the sensor indicates the cover is in a second, closed configuration (44). Where the cover is in a closed position, the logic may receive another signal from the sensor and continue this loop of receiving a signal (42) and determining if the signal from the sensor indicates the cover is in a closed position (44). The loop may be run for any desired time frame, for example, once every one to ten seconds.

When the cover is in a first configuration or open position, the processor may determine that the signal from the sensor indicates the cover is not in a closed position (44) (i.e., that the cover has just been removed by a user, or the cover is unlocked). The processor may then initiate start settings for the spa (46). For example, the processor may direct a start setting that includes playing a starting sound to audibly welcome the spa user, announce the current spa temperature and water quality, and initiate the user's custom settings for music, heat, light, water features, and/or jets. The controls for such settings may be located on the same processor that receive an input from the sensor 12, or the processor 30 may be in communication with other controllers and/or processors for controlling other spa settings.

FIG. 7 shows another schematic for possible logic that may be run on processor 30. Similar to FIG. 6, the logic may start (48) and then receive a signal from the sensor (50), then determine if the signal from the sensor indicates the cover is in a closed position (52) or locked position. Where the cover is not in a closed position, the logic may receive another signal from the sensor and continue this loop of receiving a signal (50) and determining if the signal from the sensor indicates the cover is in a closed position (52) or locked position.

When the cover is in a first configuration with the cover open or unlocked, the processor may determine that the signal from the sensor indicates the cover is not in a closed position (52) (i.e., that the cover has just been removed by a user, or the cover is not locked to the spa). The processor may then initiate start settings for the spa (54) as described above.

The processor may be further programmed with a predetermined time, "t." The predetermined time may be any desirable time and may be adjustable according to a user's desires, or may be pre-set by the manufacturer. The predetermined time may be an average or mean time that a user spends in the spa. For example, between fifteen minutes and one hour. The processor may be further programmed to continue, after the start sequence has been initiated, to receive a signal from the sensor for the predetermined time (56), then determine if the signal from the sensor indicates the cover is in a closed position (58) or locked position. Where the cover is in a closed position (the user has recently closed the cover), the processor may output instructions to begin a closing sequence or energy savings setting (60). For example, lights, jets, pumps, heat may be turned down or off. A filtration cycle may be started based on the amount of time the spa was used and an estimated bather load.

Where the cover is in an open configuration (unlocked) not in a second, closed configuration (still open) (58), the logic may continue to determine if the predetermined time has passed (62). Where the predetermined time has not passed, the logic may receive another signal from the sensor and continue this loop of receiving a signal (56) and determining if the signal indicates the cover is in a closed configuration (58).

If the predetermined time has passed, the system may require a user override or input (64). The step of requiring a user input (64) may include an audible warning to alert a user that the spa will shut down if an input is not received. It may also further include an audible alarm, such as a chirp or beep. This may alert users who have inadvertently left the spa without shutting the cover. Leaving the spa in non-use without a cover can waste energy, cause unnecessary wear and tear on a spa, and also be dangerous to children and animals who may have access to the spa in an opened state. The processor 30 may optionally be in communication with a wireless transmitter/receiver to connect to a local area network and/or the internet and send a signal to devices, such as a smart phone, to alert a user that the spa cover has not been replaced.

The logic may then determine if user input was received (66). Where user input is not received, the processor may be programmed to automatically begin the closing sequence or energy savings setting (60). This may allow for energy savings for a spa that is not in use. If a user input is received (66), the processor may then begin the loop of receiving a signal from the sensor (56).

FIG. 8 shows another possible logic without the step of requiring user input after a certain time has passed. This logic may be desirable for users who do not want the spa to require an input after a predetermined time has passed. The processor may start the logic (70), receive a signal either wirelessly or via wired communication (72), and then determine if the signal from the sensor indicates the cover is in a closed position (74). Where the cover is in a closed position, the logic may receive another signal from the sensor and continue this loop of receiving a signal (72) and determining if the signal from the sensor indicates the cover is in a closed position (74).

When the cover is in a first, open configuration, the processor may determine that the signal from the sensor indicates the cover is not in a closed position (74) (i.e., that the cover has just been removed by a user). The processor may then initiate start settings for the spa (76) as described above. After initiating start settings, the processor may then continue to receive a signal from the sensor 12 (78) while the spa is in use. The processor may determine if the signal indicates the cover is in a closed position (80). Where the signal indicates the cover is a first configuration and open, it may continue the loop of receiving a signal (78) and determining if the signal indicates the cover is in a closed position (80). Where the signal indicates the cover is closed, the processor may initiate energy saving/closed settings (82).

Figure 9:
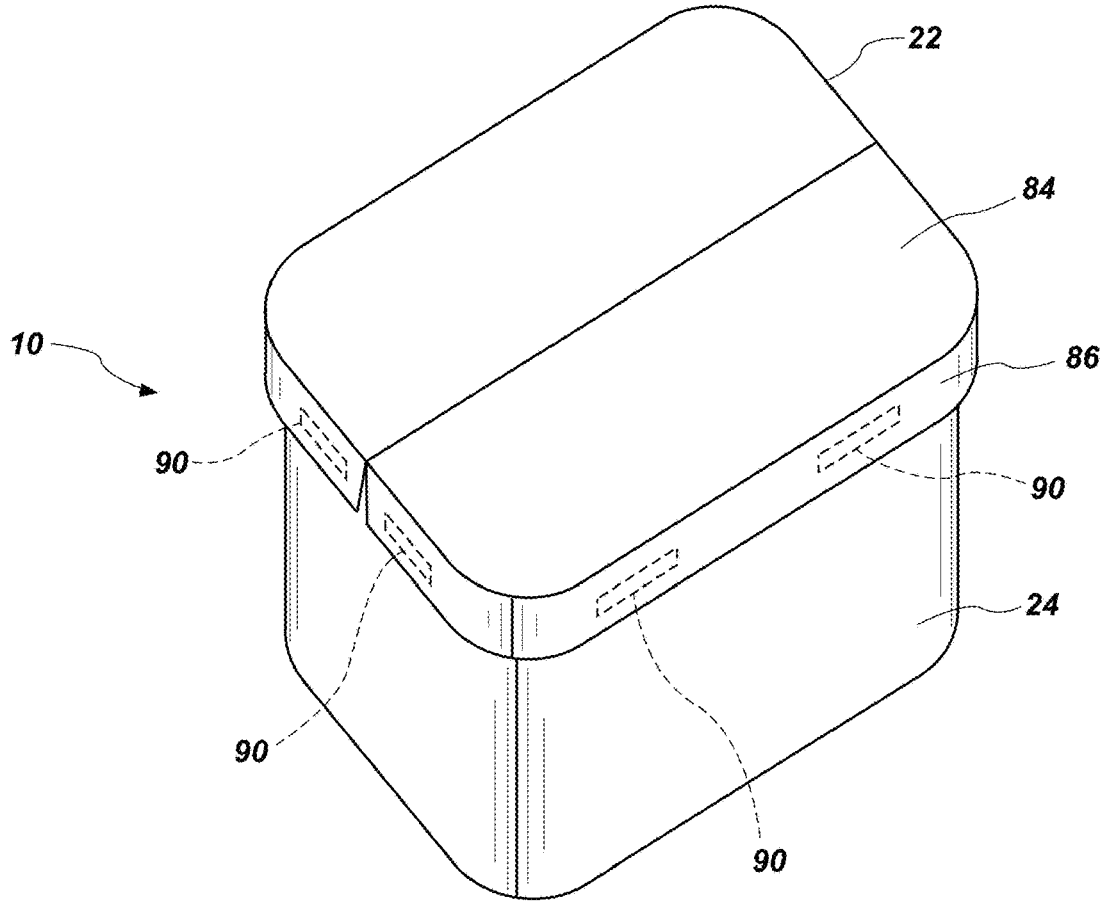
FIG. 9 is a top perspective view of a spa with a cover in place, the cover having metal inserts.
Figure 10:
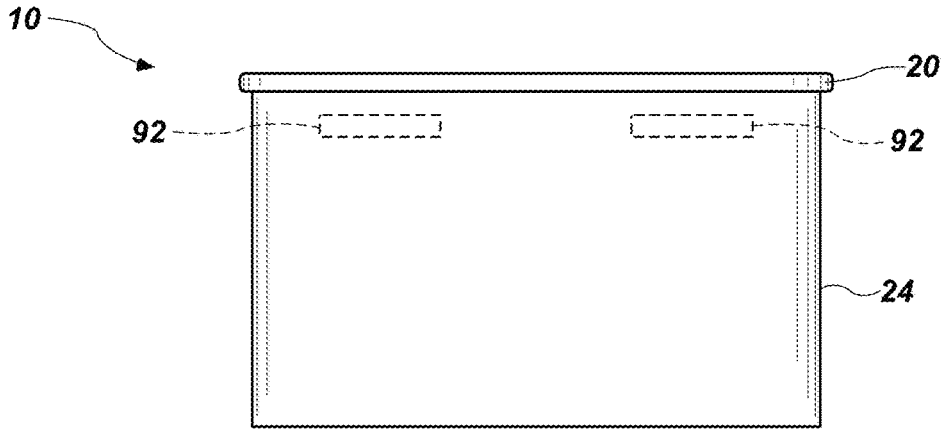
FIG. 10 is a side view of the spa of FIG. 9 without the cover in place.

Using a sensor 12 that can detect the placement of a cover 22 allows additional automated features for a spa as briefly described previously herein. FIGS. 9 and 10 shows an example of a spa 10 with a cover 22 provided with a magnetic cover locking feature. In FIG. 9 a perspective view of the spa 10 is seen with a cover 22 in place. The cover 22 may comprise a rigid top portion 84 configured to cover the top of the spa and rest on the upper edge 20 of the spa shell. The cover may also include a skirt portion 86 that hangs down and covers at least a portion of the spa cabinet 24. The cover may include one or more metal portions 90. The metal portions may be attached to the outside of the cover, or, as shown in FIG. 9, may be inserts not visible. The metal inserts 90 may be located along the edge or corners of the cover. The metal portions or inserts 90 may be placed on the skirt portion 86 or on the underside of the rigid portion 84. Electromagnets 92 may be placed in complementary locations on the spa cabinet 24 (or top side 20 of spa shell 14 in the case of metal portions 90 on the underside of the rigid portion 84 of the cover 22). FIG. 10 shows a side view of a spa (the cover is not shown in FIG. 10) with electromagnets 92 located within the spa cabinet 24. The electromagnets may be external or internal to the spa cabinet 24. It will be appreciated that the placement of the electromagnets 92 and metal portions 90 may vary so long as they are complementary placed between the cover 22 and the spa cabinet 24 or the cover 22 and the top edge 20. Further, the locking mechanism itself may vary from an electromagnetic lock and may be any other controllable lock.

The spa may be further equipped with a source of electricity for the electromagnets 92, the source of electricity being controlled by a processor that may receive a signal indicating when a cover is in place over the spa. When the signal is received that a cover is in place over the spa, the electromagnets may be energized by activating the electricity source. For example, the processor's step of initiating energy saving/close settings in FIGS. 7 and 9 may include the step of energizing the electromagnets 92, locking the spa cover 22 in place without manual effort by the user.

Figure 11:
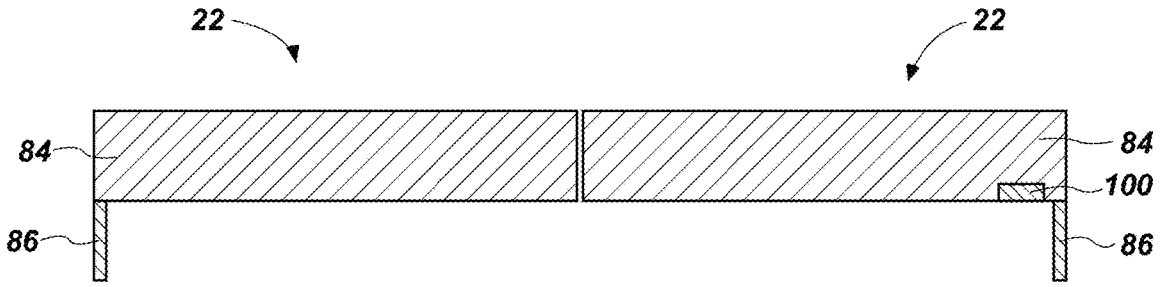
FIG. 11 is a side cross-sectional view of a spa cover with a sensor.

A smart spa cover is also contemplated herein, where the spa cover itself can determine whether or not it is in place over a spa. This may be accomplished, for example, by a spa cover 22 which is in wireless communication with the sensor 12 located on a spa. A spa cover may also be configured to independently determine if it is in place over a spa. For example, the spa cover 22 may be provided with a sensor 100. The sensor 100, as seen in FIG. 11, may be a pressure sensor which is depressed when the cover is placed in contact with the top of a spa. Similarly, the spa may include one or more magnets and the cover sensor 100 may be a magnetic proximity sensor such as a reed switch. Other sensors may be used, including but not limited to microelectromechanical (MEMS)-based magnetic field sensors, such as a Lorentz-force-based MEMS sensor, Hall effect sensors, magneto-diode, compass, inductive sensors, and capacitive sensors may be used. Similar to the spa sensor 12, a cover sensor 100 may be in communication with one or more processors/controllers.

Figure 12:
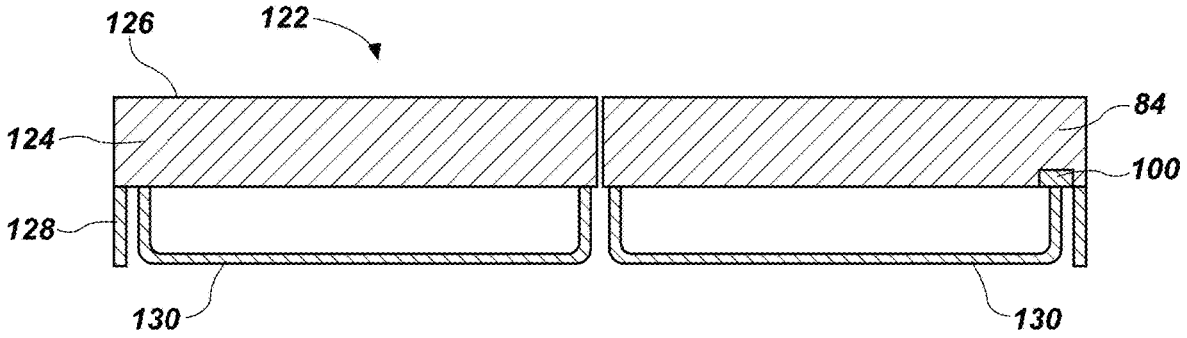
FIG. 12 is a side cross-sectional view of a spa cover with sections of floating cover.

Referring to FIG. 12, another type of spa cover 122 is shown which may be used independently or in conjunction with a cover sensor, such as a sensor 12 located on a spa or a sensor 100 located on a cover. The spa cover 122 may include an upper, rigid portion 124. This rigid portion 124 may be similar to standard foam-core type spa covers, or other rigid covers such as breathable rigid covers known in the art. The rigid portion may have a top side 126 and an underside 128. The underside 128 may have a floating-type cover 130 attached thereto. The floating cover 130 may be attached to the underside 128 at the ends and descend downwardly to rest on the surface of the water. The floating cover 130 may include one or more sections. For example, FIG. 12 shows two sections of floating cover 130, each attached to the underside 128 of the cover 122 at the end and middle of the cover 122. The floating cover 130 may be a single piece of material adhered, connected to or engaged to the underside 128 around a periphery, or near the periphery. Alternatively, the floating cover 130 may include multiple sections, or folds, of a single floating cover adhered in multiple locations on the underside 128. Furthermore, the floating cover 130 may be a plurality of floating covers (similar to those found in FIG. 13) that engage the underside in patterned positions on the underside 128 and each of the plurality of floating covers engage each other laterally or on their sides (see FIG. 13) to increase the insulation and insulating properties of the floating cover 130.

The floating cover 130 may be comprised of a length of insulating material. The length of the floating cover 130 may be greater than the length of the rigid portion 124, such that the length of the floating cover 130 descends or hangs downwardly from the underside of the rigid portion. The floating cover 130 is intended to engage the water that resides within the spa 10; however, the floating cover may not engage the water within the spa as well and determined by the amount of water in the spa 10.

Figure 13:
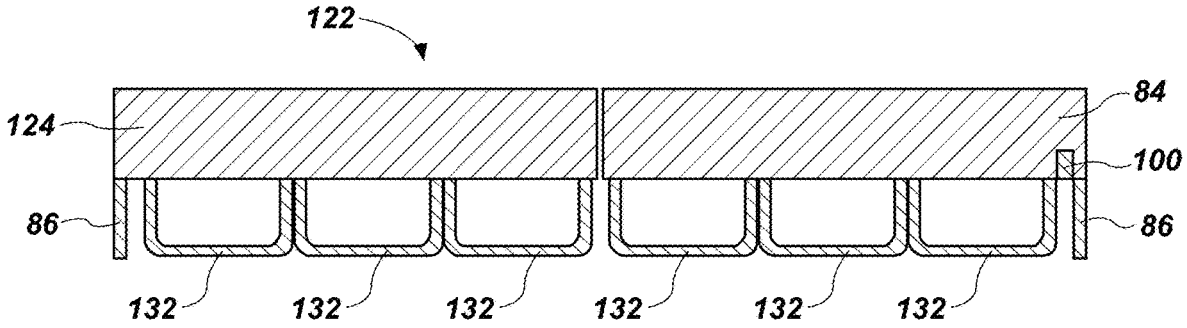
FIG. 13 is a side cross-sectional view of a spa cover with sections of an alternate floating cover.

FIG. 13 shows a separate embodiment, however, similar cover with a rigid portion and one or more sections of a floating cover 132. The floating cover 132 may be inflatable or may simply be multiple sections of a single floating cover. In this configuration, the sensor on the spa or the cover may be in communication with a controller in the cover for the one or more sections of inflatable floating cover. Electronics to inflate one or more sections of inflatable floating cover 132 may be activated when the sensor detects that the cover is in place over a spa. Similarly, the sections of inflatable floating cover 132 may be automatically deflated when the sensor detects the cover is removed. The step of inflating the floating cover 132 may be part of the initiate energy saving/close setting of the logic shown in FIGS. 7 and 8, for example (60 and 82, respectively).

It will be appreciated that any number of ways may be used to configure a spa and spa cover with a sensor and are contemplated and included within the scope of this configuration. The sensor may be integral to the spa as in a newly manufactured spa; however, the sensor may also be retrofitted to a spa. Alternatively, the sensor may be located in the cover and in communication with a processor/controller in the spa.

While the current spa cover 22 and 122 design is shown as a rectangle or square in shape, alternate shapes are contemplated beyond a rectangle, square and any shape may be used that would fit a spa, spa pool, pool, etc.

Additionally, the materials utilized to make the spa and the cover may be standard in the industry and may include and are not limited to such materials as metal, metal-alloys, polymers, fiberglass, wood, carbon-fiber and others.

Disclosed herein is a system for covering a spa, comprising: a spa tub, a sensor configured to determine when a cover is in a first, open configuration and a second, closed configuration over the spa. The sensor may comprise a contact sensor, a proximity sensor, a light sensor, photoresistor, a photodiode, and a phototransistor, for example. The spa tub may comprise a spa shell having a top edge, the sensor located on the top edge of the spa shell. The system may further comprise a spa cover, the spa cover comprising a magnet. The sensor may comprise a sensor selected from the group consisting of a Hall effect sensor, a reed switch, a microelectromechanical-based magnetic field sensor, a Lorentz-force-based sensor, a magnetometer, an inductive sensor, and a capacitive sensor.

The system for covering a spa may further comprise a processor, and wherein the sensor is in communication with the processor, the processor being programmed to receive a signal from the sensor, determine if the signal from the sensor indicates a cover is in a second, closed configuration over the spa, and initiate a start sequence for one or more spa settings when the signal from the sensor indicates the cover is not in a closed position over the spa. The communication between the processor and the sensor may be wireless or wired.

The processor may be communication with one or more controls for temperature settings, light settings, heat settings, music settings, and jet settings. The processor may be further programmed to continue to receive a signal from the sensor after the start sequence is initiated. The processor may be further programmed to initiate energy-savings settings when the signal from the sensor indicates a cover is in a second, closed configuration over the spa. The processor may be further programmed to initiate a close sequence including a filtration cycle. The processor may be further programmed to receive a signal indicating a time of spa use and to receive a signal indicating bather load and to calculate the filtration cycle by the signal indicating the time of spa use and the signal indicating bather load.

The system for covering a spa may comprise a spa cover with outer edges, the spa cover comprising one or more pieces of metal disposed proximal to the outer edges; and wherein the spa tub comprises one or more electromagnets. The system may further comprise a processor, and wherein the sensor and the one or more electromagnets are in communication with the processor, the processor being programmed to receive a signal from the sensor, determine if the signal from the sensor indicates a cover is in a second, closed configuration over the spa, and send a signal to provide power to the one or more electromagnets when the processor receives a signal from the sensor indicating the spa cover is in a second, closed configuration over the spa.

Disclosed herein is a spa cover system comprising: a rigid portion; a floating portion; and a sensor disposed on the rigid portion configured to determine if the spa cover is in a first configuration or a second configuration. The rigid portion may comprise one or more panels connected via a hinge, and wherein the sensor comprises a pressure sensor. The rigid portion may comprise a first panel and a second panel, the first panel connected to the second panel via a hinge, and wherein the sensor comprises a pressure sensor disposed proximal to the hinge. The rigid portion may comprise a top side and an underside, and further comprising a spa tub, the spa tub having a top edge; wherein the underside of the rigid portion of the spa cover is configured to rest on the top edge of the spa tub when the spa cover is in the second configuration.

The sensor may comprise a contact sensor, such as a reed switch and a magnet. The rigid portion may comprise a top side and a underside, and wherein the floating portion comprises a length of insulating material connected to the bottom side of the rigid portion. The rigid portion may comprise a first panel and a second panel, the first panel connected to the second panel via a hinge, and wherein the length of insulating material comprises a first length of insulating material and a second length of insulating material, the first length of insulating material connected to the first panel and the second length of insulating material connected to the second panel.

The rigid portion may have a length and the length of insulating material may have a length, and wherein the length of the insulating material is greater than the length of the rigid portion. The first panel may have a length and the second panel may have a length; the first length of insulating material having a length and the second length of insulating material having a length; wherein the length of the first length of insulating material is greater than the length of the first panel and wherein the length of the second length of insulating material is greater than the length of the second panel.

The floating portion may comprise one or more inflatable bladders connected to a bottom side of the rigid portion. The spa cover system may further comprise a processor in communication with the sensor and the one or more inflatable bladders. The processor may be programmed to receive a signal from the sensor, the signal indicating whether the spa cover is in a first configuration open position or a second configuration, and wherein the processor is further programmed to send a signal to the one or more inflatable bladders to inflate when the processor receives a signal from the sensor indicating the spa cover is in the second closed configuration. The one or more inflatable bladders may comprise self-inflating bladders.

According to another aspect, a spa cover system is described, comprising: a rigid structure having a topside and an underside; and a floating cover attached to the underside of the rigid structure.

Although the foregoing disclosure provides many specifics, such as use of the system in spas, it will be appreciated that pools, and other water holding devices to be covered are contemplated and these should not be construed as limiting the scope of any of the ensuing claims. Other embodiments and configurations may be devised which do not depart from the scopes of the claims. Features from different embodiments and configurations may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A system for covering a spa, comprising:

a spa tub including one or more electromagnets, a spa cover with outer edges, the spa cover comprising one or more pieces of metal disposed proximal to the outer edges; and a sensor configured to determine when a cover is in a first, open configuration and a second, closed configuration over the spa.

2. The system for covering a spa of claim 1, wherein the sensor comprises a contact sensor.

3. The system for covering a spa heated spa of claim 1, wherein the sensor comprises a proximity sensor.

4. The system for covering a spa of claim 1, wherein the spa tub comprises a spa shell having a top edge, the sensor located on the top edge of the spa shell.

5. The system for covering a spa of claim 4, wherein the sensor comprises a pressure sensor.

6. The system for covering a spa of claim 1, wherein the sensor comprises a light sensor.

7. The system for covering a spa of claim 6, wherein the light sensor comprises one or more of a photoresistor, a photodiode, and a phototransistor.

8. The system for covering a spa of claim 1, further comprising a spa cover, the spa cover comprising a magnet.

9. The system for covering a spa of claim 1, wherein the sensor comprises a sensor selected from the group consisting of a Hall effect sensor, a reed switch, a microelectromechanical-based magnetic field sensor, a Lorentz-force-based sensor, a magnetometer, an inductive sensor, and a capacitive sensor.

10. The system for covering a spa of claim 1, further comprising a processor, and wherein the sensor is in communication with the processor, the processor being programmed to receive a signal from the sensor, determine if the signal from the sensor indicates a cover is in a second, closed configuration over the spa, and initiate a start sequence for one or more spa settings when the signal from the sensor indicates the cover is not in a closed position over the spa.

11. The system for covering a spa of claim 10, wherein communication between the processor and the sensor is wireless.

12. The system for covering a spa of claim 10, wherein communication between the processor and the sensor is wired.

13. The system for covering a spa of claim 10, wherein the processor is in communication with one or more controls for locking settings, temperature settings, light settings, heat settings, music settings, and jet settings.

14. The system for covering a spa of claim 10, wherein the processor is further programmed to continue to receive a signal from the sensor after the start sequence is initiated.

15. The system for covering a spa of claim 14, wherein the processor is further programmed to initiate energy-savings settings when the signal from the sensor indicates a cover is in a second, closed configuration over the spa.

16. The system for covering a spa of claim 14, wherein the processor is further programmed to initiate a close sequence including a filtration cycle.

17. The system for covering a spa of claim 16, wherein the processor is further programmed to receive a signal indicating a time of spa use and to receive a signal indicating bather load and to calculate the filtration cycle by the signal indicating the time of spa use and the signal indicating bather load.

18. The system for covering a spa of claim 1, further comprising a processor, and wherein the sensor and the one or more electromagnets are in communication with the processor, the processor being programmed to receive a signal from the sensor, determine if the signal from the sensor indicates a cover is in a second, closed configuration over the spa, and send a signal to provide power to the one or more electromagnets when the processor receives a signal from the sensor indicating the spa cover is in a second, closed configuration over the spa.

19. A spa cover system comprising:

a rigid portion;

a floating portion;

a spa cover having outer edges, the spa cover comprising one or more pieces of metal disposed proximal to the outer edges, and a sensor disposed on the spa cover configured to determine if the spa cover is in a first configuration or a second configuration; and a spa including one or more electromagnets.

20. The spa cover system of claim 19, wherein the rigid portion comprises one or more panels connected via a hinge, and wherein the sensor comprises a pressure sensor.

21. The spa cover system of claim 19, wherein the rigid portion comprises a first panel and a second panel, the first panel connected to the second panel via a hinge, and wherein the sensor comprises a pressure sensor disposed proximal to the hinge.

22. The spa cover system of claim 19, the rigid portion comprising a top side and an underside; wherein the underside of the rigid portion of the spa cover is configured to rest on a top edge of the spa when the spa cover is in the second configuration.

23. The spa cover system of claim 22, wherein the sensor comprises a contact sensor.

24. The spa cover system of claim 23, wherein the sensor comprises a reed switch and a magnet.

25. The spa cover system of claim 24, wherein the floating portion comprises one or more inflatable bladders connected to a bottom side of the rigid portion.

26. The spa cover system of claim 25, further comprising a processor in communication with the sensor and the one or more inflatable bladders.

27. The spa cover system of claim 26, wherein the processor is programmed to receive a signal from the sensor, the signal indicating whether the spa cover is in a first configuration open position or a second configuration, and wherein the processor is further programmed to send a signal to the one or more inflatable bladders to inflate when the processor receives a signal from the sensor indicating the spa cover is in the second configuration.

28. The spa cover system of claim 27, wherein the one or more inflatable bladders comprise self-inflating bladders.

29. The spa cover system of claim 19, the rigid portion comprising a top side and a underside, and wherein the floating portion comprises a length of insulating material connected to the under side of the rigid portion.

30. The spa cover system of claim 29, wherein the rigid portion comprises a first panel and a second panel, the first panel connected to the second panel via a hinge, and wherein the length of material comprises a first length of insulating material and a second length of insulating material, the first length of insulating material connected to the first panel and the second length of insulating material connected to the second panel.

31. The spa cover system of claim 29, the rigid portion having a first length, and wherein the length the insulating material is greater than the first length of the rigid portion.

32. A spa cover system, comprising:

a rigid structure having a topside and an underside, the rigid structure having outer edges, the rigid structure comprising one or more pieces of metal disposed proximal to the outer edges;

a floating cover attached to the underside of the rigid structure; and a spa tub including one or more electromagnets.

33. The spa cover system of claim 32 comprising, a sensor positioned on the rigid structure configured to determine if the spa cover is in a first configuration or a second configuration.

34. The spa cover system of claim 33, wherein the underside of the rigid structure is configured to rest on a top edge of a spa tub when the spa cover is in the second configuration.

35. The spa cover system of claim 32, wherein the floating cover comprises a first length and the rigid structure comprises a second length, wherein the first length is greater than the second length.

36. The spa cover system of claim 32, wherein the floating cover comprises a plurality of floating covers.

37. The spa cover system of claim 36, wherein the plurality of floating covers comprise a collective first length and the rigid structure comprises a second length, wherein the collective first length is greater than the second length.

38. The spa cover system of claim 32, wherein the floating cover is insulated.

* * * * *